US005267735A

United States Patent [19]

Bushman

[11] Patent Number: 5,267,735

[45] Date of Patent: Dec. 7, 1993

[54] JAVELIN

[76] Inventor: Earl K. Bushman, 2756 N. Green Valley Pkwy., No. 294, Henderson, Nev. 89014

[21] Appl. No.: 956,166

[22] Filed: Oct. 5, 1992

[51] Int. Cl.[5] ..... A63B 65/00

[52] U.S. Cl. ..... 273/428; 273/420; 273/423; 482/20

[58] Field of Search ..... 482/20; 273/416, 419, 273/420, 422, 423, 428

[56] References Cited

U.S. PATENT DOCUMENTS 3,746,334 7/1973 Stubblefield ..... 482/20
3,784,199 1/1974 Chmela ..... 273/398
4,021,041 5/1977 Goldfarb et al. ..... 273/420

*Primary Examiner*—William H. Grieb
*Attorney, Agent, or Firm*—Allen A. Dicke, Jr.

[57] ABSTRACT

The javelin is a hand-thrown toy having a tubular fuselage. Mounted on the forward end of the fuselage are four canard planes, and mounted adjacent the rear of the fuselage are four tail planes. The forward surfaces and rear surfaces are each at a right angle and straight with respect to the fuselage to prevent spinning. The forward and rear surfaces are positioned at 45 degrees with respect to each other. The surfaces are sized as compared to fuselage length and weight so that the javelin flies level without spinning. A soft nose ring attached to the forward end of the fuselage prevents damaging impact.

22 Claims, 2 Drawing Sheets

JAVELIN

FIELD OF THE INVENTION

This invention is directed to a hand-thrown toy javelin which flies substantially level.

BACKGROUND OF THE INVENTION

Various play devices have been made for throwing. Balls are one class of such devices and are well-known. Another of the devices thrown for play is the dart. The dart has a body to which tail surfaces are attached to prevent tumbling and give it some longitudinal stability. Darts are thrown on a ballistic trajectory because they have little lift. Darts must be fairly heavy to travel well since they are principally ballistic devices. These conditions make the dart dangerous unless a great deal of caution in design is employed to reduce its impact energy.

The ordinary javelin is another device which is principally a ballistic device. The javelin used in traditional field events is a long, thin, solid shaft which represents a weapon of the past. It is thrown on a substantially ballistic trajectory because there is little surface area compared to the weight. The traditional javelin is intended to strike hard and penetrate.

Another thrown device is the aerodynamic disc or FRISBEE. The FRISBEE relies on spinning on its central axis for stability and gets lift from its shape. Since it gets aerodynamic lift in its travel, it can travel on a flatter trajectory rather than a ballistic trajectory. This is desirable because, during play, it can be caught anywhere along the length of its substantially level path. There is need for another plaything which is safe to handle and throw even where there are people and which flies on a substantially level, non-ballistic flight so that it can go a substantial distance without a great deal of throwing effort and be caught along its path. Such a device will fill a need among playthings.

SUMMARY OF THE INVENTION

This invention is directed to a javelin which has a tubular fuselage of substantially uniform cross-section and which carries canard planes adjacent its forward end and tail planes adjacent its rear end, with the planes being configured and sized to provide lift and guidance so that the javelin travels in substantially level, straight flight.

It is, thus, an object and advantage of this invention to provide a javelin-like plaything for throwing which can be easily thrown and which can travel at a level long flight beyond the length limits of the ballistic trajectory.

It is another object and advantage of this invention to provide an inexpensive javelin plaything which is safe so that it can be thrown on a substantially level flight from one person to another.

It is a further object and advantage of this invention to provide a javelin plaything which has a tubular fuselage together with canard and tail planes, all sized for maximum flight.

It is a further object and advantage of this invention to provide a javelin-type plaything for throwing which has its fuselage recessed behind its canard planes and which has a nose ring to minimize impact damage.

Other objects and advantages of this invention will become apparent from a study of the following portion of the specification, the claims and the attached drawings.

BRIEF DESCRIPTION OF THE DRAWINGS

FIG. 5 is an enlarged sectional view and alternate embodiment of the fuselage tube.

DESCRIPTION OF THE PREFERRED EMBODIMENT

Figure 1:
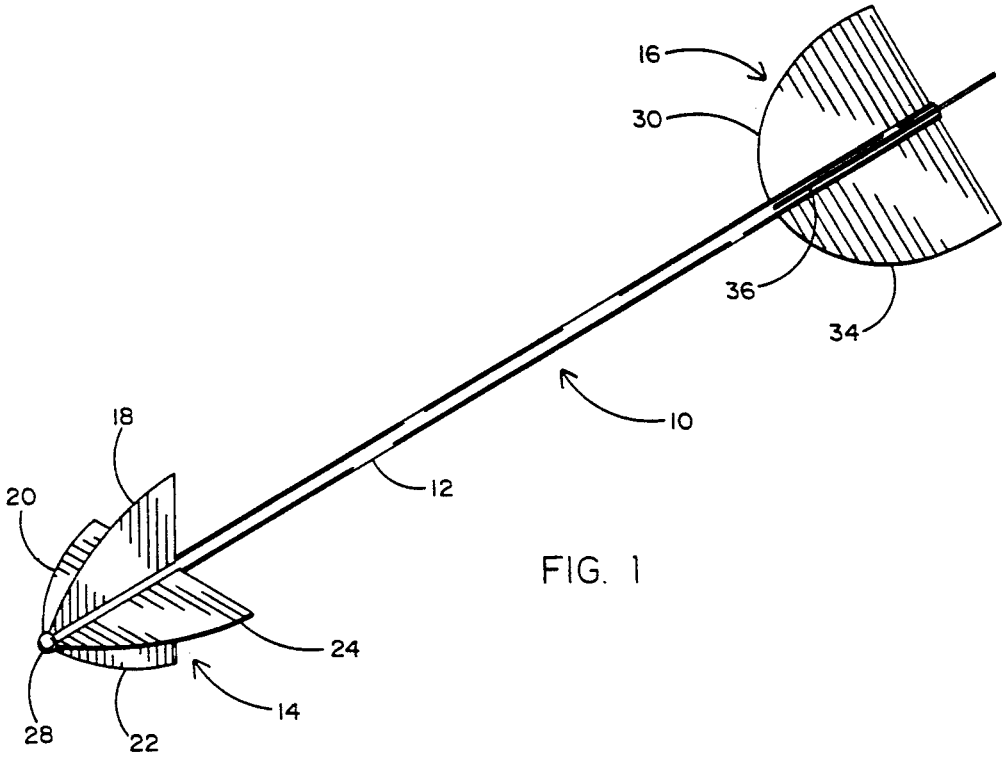
FIG. 1 is an isometric view of the javelin of this invention.
Figure 2:
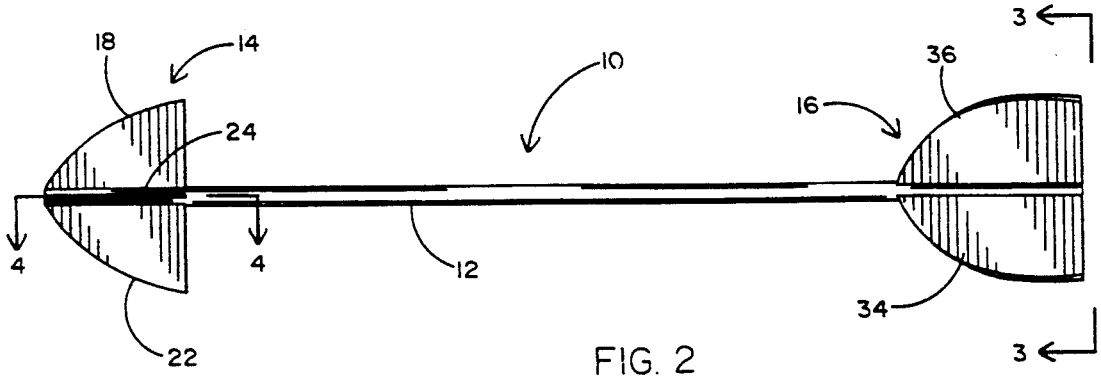
FIG. 2 is a side-elevational view thereof.
Figure 3:
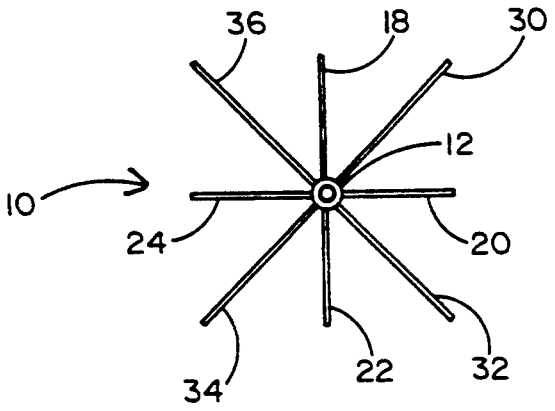
FIG. 3 is a rear-elevational view thereof, as seen generally along line 3—3 of FIG. 2.

The javelin of this invention is generally indicated at 10 in FIGS. 1, 2 and 3. The javelin 10 has a fuselage 12, canard forward planes 14 secured adjacent the forward end of the fuselage, and rear tail planes 16 secured adjacent the rear end of the fuselage.

Fuselage 12 is a fairly stiff tubing of right circular section and uniform wall thickness. In a preferred example of the javelin, the fuselage is polycarbonate tubing having a ½ inch outside diameter and ⅜ inch inside diameter is a suitable size for a javelin 36 inches long.

Figure 4:
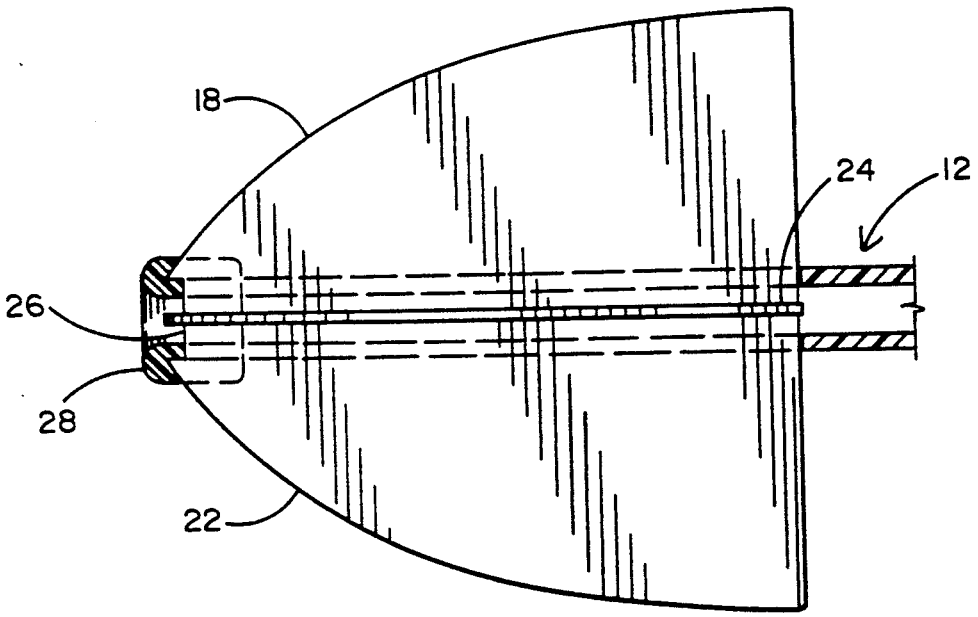
FIG. 4 is an enlarged section, with parts broken away, taken generally along line 4—4 of FIG. 2.
Figure 4:
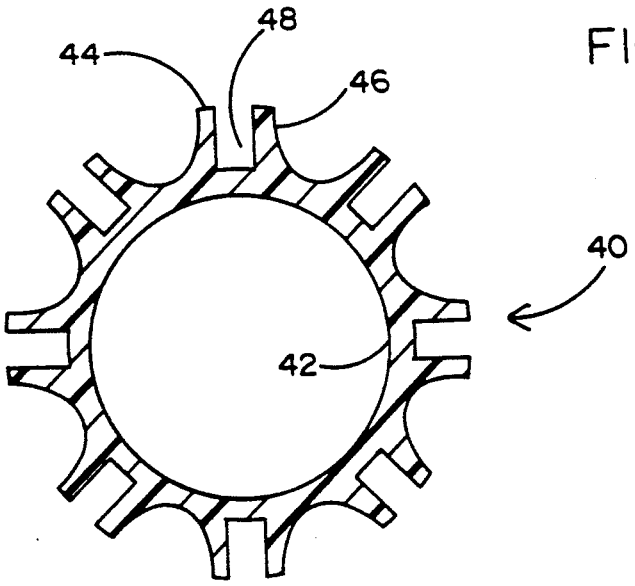

There are four forward canard planes 18, 20, 22 and 24. The canard planes are attached to the fuselage tube adjacent the forward end thereof. As seen in FIG. 4, the fuselage tube 12 terminates in a forward end 26, and the canard planes are positioned on the tubular fuselage 12 to extend slightly forward, such as ½ inch forward of the fuselage. The canard planes are attached to the fuselage at right angles to each other, see FIG. 3. The shape of the projected side surface of the canard planes is substantially semi-elliptical, as the term is used in defining aircraft wing shapes. The canard planes can be attached by any convenient means. The canard planes are made of flexible synthetic polymer sheet which may be solid, but is preferably a foamed sheet with smooth surfaces to minimize weight.

In order to protect the nose of the javelin further and minimize impact damage, nose ring 28 is provided. The nose ring 28 is in the form of a tube which engages on the outside of the fuselage and which is slotted to receive the canard planes. Forward of the canard planes, the nose ring is a complete annular ring of substantially hemi-circular cross section. This part reaches in between the planes 14 to engage on the front of the fuselage tube. The nose ring 28 is made of soft material, such as foam rubber or rubberlike synthetic material to aid in absorbing impact to minimize damage by the javelin and to the javelin when it strikes. Nose ring 28 engages between the canard planes to give them additional strength.

There are also four rear tail planes 30, 32, 34 and 36, as seen in FIG. 3. The tail planes are also arranged at right angles with respect to each other. As best seen in FIG. 3, the orthogonal relationship of the tail planes is at 45 degrees with respect to the orthogonal relationship of the canard planes. This angular offset of the canard to tail lanes minimizes turbulence therebetween to eliminate rotation on the fuselage axis. In addition, the tail planes are larger than the canard planes. The canard planes are each of the same size, the tail planes are each of the same size, and the tail planes are larger, as seen in FIG. 3. The canard planes are about 40 to 50 percent of the area of the tail planes. The tail planes define the diagonals of a square, while the canard planes define the sides of the same square. The tail planes are also of semi-elliptical plan form. The width of each plane is preferably about 57 to 59 percent of its length. The tail planes are made of material similar to the tail planes.

The fuselage has an axis, and each of the planes lies in a plane which passes through that axis. This construction is such as not to induce spinning of the javelin on its axis. All of the planes are straight on the axis so that spinning does not occur. The 45 degree offset between the canard and tail plane appears to prevent the turbulence of the canard planes from disturbing the tail planes and, as a result, the javelin does not spin on its axis and gains better lift, thus following a straight level path rather than a ballistic path. Four canard planes and four tail planes present the preferred number. Less than four will not work satisfactorily to prevent the spinning, and more than five seem to cause turbulence which prevents non-rotating flight. Thus, four is the preferred number of planes, but five planes are operative if carefully constructed.

The weight of the javelin is very important. The major part of the weight is provided by the fuselage tubing, which is either made of acrylonitrile or polycarbonate material. A fuselage tube having a ½ inch OD and ⅜ inch ID for a javelin from 30 to 36 inches long presents the maximum practical weight. Minimizing the weight of the canard and tail planes is also necessary. The lightest tail planes are made of styrofoam sheet. Solid synthetic polymer sheet is heavier, but may attach more satisfactorily.

Fuselage 40 is indicated in enlarged cross section in FIG. 5. Fuselage 40 is also tubular and has a right cylindrical interior surface 42. The exterior surface is provided with longitudinal flanges which are part of the extruded shape of the fuselage tube. Flanges 44 and 46 are specifically identified and define a slot 48 therebetween. The slot 48 is used for receiving the canard plane 18. With its slot configuration, the canard plane is easily secured. The seven other slots defined by corresponding flanges around the outer surface of the fuselage 40 are arranged at 45 degrees with respect to each other so that alternate slots can hold canard and tail planes. The wall thickness of the fuselage 40 is such as to provide the desired stiffness to the fuselage, especially considering the outwardly extending flanges which add stiffness thereto.

The javelin thus constructed, when thrown, sustains a long, substantially level and substantially straight flight trajectory. The relationship in size and shape of the forward and rear planes cause the javelin to either rise or float to the ground, thus affecting the distance it can be thrown. When in proper relationship, the javelin does not have a ballistic trajectory, but has a substantially horizontal flight trajectory. The four forward canard planes and four rear tail planes are necessary to provide the lift and stabilize the directional flight when it is thrown. The javelin travels as far as possible while maintaining a fairly level and straight path. In addition, the javelin is configured so that it can be easily thrown. A smaller or weaker person can thrown the javelin and obtain level flight. The tubular fuselage is also important in the guidance stability of the javelin when it is thrown. The tubular fuselage appears to enable the javelin to resist being blown off course by having the javelin cut into the cross-wind, thus self-correcting its flight path to the target.

With respect to safety, the fact that the forward canard planes protrude beyond the fuselage from ¼ to ½ inch prevents the fuselage from immediate direct contact with a target. In addition, the soft nose ring 28 absorbs energy to dampen the impact. The result is a softer blow than the blow of the edge of a FRISBEE. The level flight of the javelin permits it to be caught along its path, like a FRISBEE. These results produce a javelin which is easy to throw and catch for children and adults alike, as well as provide safe play.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A javelin comprising:

an elongated fuselage of substantially uniform cross section, said fuselage being tubular, said fuselage having a longitudinal axis and said fuselage having a forward end and a rear end;

at least four canard planes secured to said fuselage adjacent its forward end, said canard planes being substantially equi-angularly spaced around said axis; and at least four tail planes attached to said fuselage adjacent its rear end, said tail planes being substantially equi-angularly spaced around said fuselage, each of said canard planes and each of said tail planes substantially intersecting said axis so that said javelin does not spin on its axis in flight, and each of said canard planes being positioned around said fuselage at an angle which substantially bisects the angle between two adjacent of said tail planes.

2. The javelin of claim 1 wherein the area at each of the canard planes is about 40 to 45 percent of the area of said tail planes.

3. The javelin of claim 1 wherein the length ratio of each of said planes is about 57 to 59 percent.

4. The javelin of claim 1 further including a nose ring on the forward end of said fuselage, said nose ring being made of soft material to absorb impact, said nose ring having an opening therein in line with said tubular opening through said fuselage.

5. The javelin of claim 4 wherein said nose ring has a skirt thereon, said skirt having slots therein to receive corresponding canard planes.

6. A javelin comprising:

an elongated fuselage of substantially uniform cross section, said fuselage being tubular, said fuselage having a longitudinal axis and said fuselage having a forward end and a rear end;

at least four canard planes secured to said fuselage adjacent its forward end, said canard planes being substantially equi-angularly spaced around said axis; and at least four tail planes attached to said fuselage adjacent its rear end, said tail planes being substantially equi-angularly spaced around said fuselage, a nose ring on the forward end of said fuselage, said nose ring being made of soft material to absorb impact, said nose ring having an opening therein in line with said tubular opening through said fuselage to permit air flow through said nose ring and said fuselage.

7. The javelin of claim 6 wherein said nose ring has a skirt thereon, said skirt having slots therein to receive corresponding canard planes.

8. The javelin of claim 7 wherein each of said canard planes and each of said tail planes substantially intersect said axis so that said javelin does not spin on its axis in flight.

9. The javelin of claim 7 wherein each of said canard planes is positioned around said fuselage at an angle which substantially bisects the angle between two adjacent of said tail planes.

10. The javelin of claim 9 wherein the area at each of the canard planes is about 40 to 45 percent of the area of said tail planes.

11. The javelin of claim 10 wherein the length ratio of each of said planes is about 57 to 59 percent.

12. A javelin comprising:

a fuselage, said fuselage being tubular and being of substantially uniform cross section, said tubular fuselage having a forward end and a rear end, said tube of said tubular fuselage being open throughout its length from said forward end to its rearward end, said fuselage being substantially straight and having an axis;

four canard planes attached to said fuselage adjacent its forward end, each of said canard planes being substantially planar and each being of substantially the same size and shape and each of said canard planes lying substantially on said axis; and four tail planes attached to said fuselage adjacent its rear end, each of said tail planes being substantially planar and each being of substantially the same size and shape, said tail planes being larger than said canard planes and each of said tail planes lying substantially on said axis so that said javelin does not spin in flight, said canard planes and said tail planes each being substantially equi-angularly spaced around said axis.

13. The javelin of claim 12 wherein said canard planes are each positioned at an angle around said axis so as to substantially bisect the angle between adjacent said tail planes.

14. The javelin of claim 12 wherein said tail planes define the diagonals of a square and said canard planes are equal in radius to the sides of the same square.

15. The javelin of claim 12 wherein the area at each of the canard planes is about 40 to 45 percent of the area of said tail planes.

16. The javelin of claim 15 wherein the length ratio of each of said planes is about 57 to 59 percent.

17. The javelin of claim 12 wherein said fuselage is made of synthetic polymer composition material and said planes are made of synthetic polymer composition material, with said planes being of softer material than said fuselage.

18. The javelin of claim 17 wherein said canard surfaces extend forward of said forward end of said fuselage so that said canard planes impact first upon a target to soften the impact of said fuselage.

19. The javelin of claim 18 further including a nose ring on said forward end of said fuselage, said nose ring having an opening therein corresponding to and in line with said tubular opening in said fuselage, said nose ring being made of material softer than said canard planes to soften impact.

20. The javelin of claim 19 wherein said canard planes and said tail planes are each substantially equi-angularly spaced around said axis.

21. The javelin of claim 20 wherein said canard planes is are each positioned at an angle around said axis so as to substantially bisect the angle between said tail planes.

22. The javelin of claim 21 wherein said tail planes define the diagonals of a square and said canard planes are equal in radius to the sides of the same square.

* * * * *